US006823539B1

(12) United States Patent
Bantz

(10) Patent No.: US 6,823,539 B1
(45) Date of Patent: Nov. 30, 2004

(54) CASCADING TUB FILLER AND OVERFLOW ASSEMBLY

(75) Inventor: Shannon R. Bantz, Michigan City, IN (US)

(73) Assignee: Geberit Technik AG, Jona (CH)

( * ) Notice: Subject to any disclaimer, the term of this patent is extended or adjusted under 35 U.S.C. 154(b) by 0 days.

(21) Appl. No.: 10/672,147

(22) Filed: Sep. 25, 2003

(51) Int. Cl.[7] ..... E03C 1/01

(52) U.S. Cl. ..... 4/675

(58) Field of Search ..... 4/671, 674, 675, 4/678, 591

(56) References Cited

U.S. PATENT DOCUMENTS

| | | | | | |
|---|---|---|---|---|---|
| 399,691 | A | * | 3/1889 | Newell | 4/674 |
| 1,617,078 | A | * | 2/1927 | Pasman | 4/674 |
| 1,658,159 | A | | 2/1928 | Ernst et al. | |
| 1,994,789 | A | * | 3/1935 | Redmond et al. | 4/681 |
| 3,684,191 | A | * | 8/1972 | Shames et al. | 239/428.5 |
| 3,730,439 | A | * | 5/1973 | Parkison | 239/590.3 |
| 3,851,825 | A | * | 12/1974 | Parkison et al. | 239/590.3 |
| 5,114,072 | A | * | 5/1992 | Barhydt, Sr. | 239/428.5 |
| 6,219,858 | B1 | | 4/2001 | Farmer | |
| 6,292,958 | B1 | * | 9/2001 | Benne et al. | 4/674 |
| 6,421,848 | B2 | * | 7/2002 | Farmer | 4/674 |

OTHER PUBLICATIONS

Drawings of Geberit product; 1989.
Geberit DELTA Brochure; 1991.
Geberit MONTAGE Brochure; 1996.
Geberit The Science of the Bath Publication; date unknown; prior to present invention.

* cited by examiner

*Primary Examiner*—Gregory L. Huson
*Assistant Examiner*—Huyen Le
(74) *Attorney, Agent, or Firm*—Greer, Burns & Crain, Ltd.; Philip M. Kolehmainen

(57) ABSTRACT

An inner and an outer body are clamped toward opposite faces of a tub wall over a tub overflow opening. Excess water flows from the tub through an overflow outlet water passage extending through the inner and outer bodies. A water inlet passage has an inlet in the outer body and a non-circular outlet in the inner body. Flow from the tub into the water supply is prevented by a check valve in the water inlet passage. An inlet water conditioning assembly is supported at the outlet of the water inlet passage to provide a smooth, controlled, laminar cascading flow into the tub. The inlet water conditioning assembly includes a flow straightener with parallel blades parallel to the flow direction dividing the total flow into segments that are reunited in a header region at the outlet of the flow straightener. A screen assembly downstream from the header region includes a number of wire mesh screen laminas each having a wire direction angularly offset from the wire direction of adjacent screens.

15 Claims, 4 Drawing Sheets

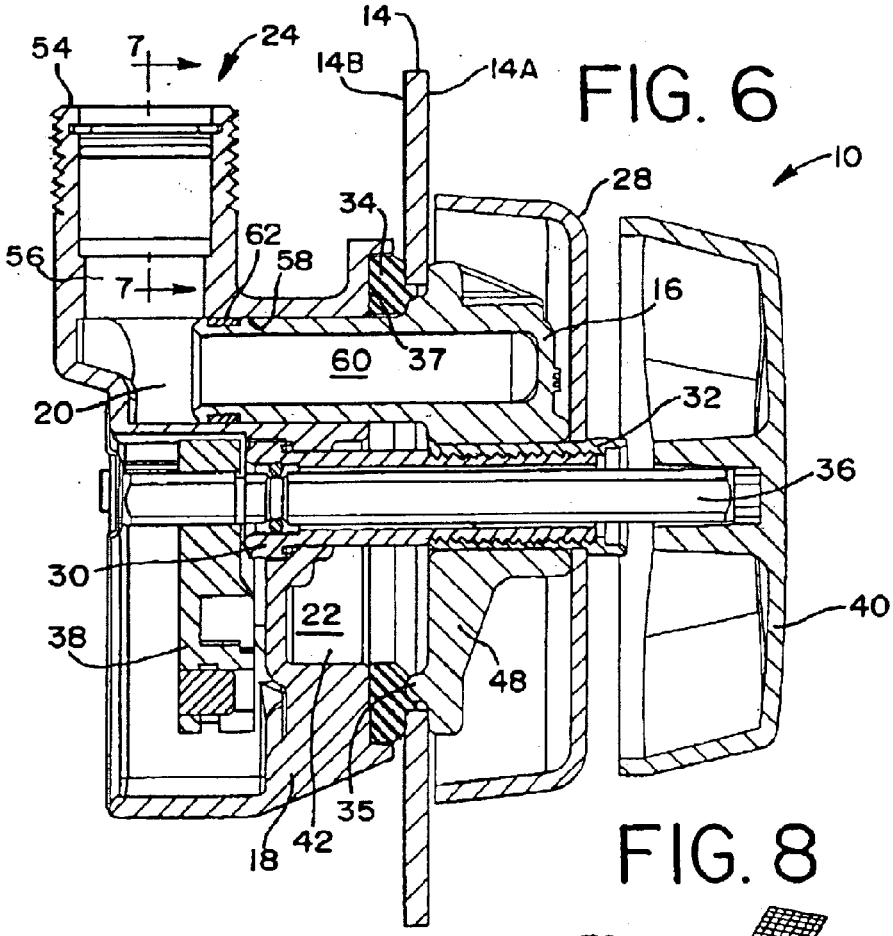
FIG. 6
FIG. 8
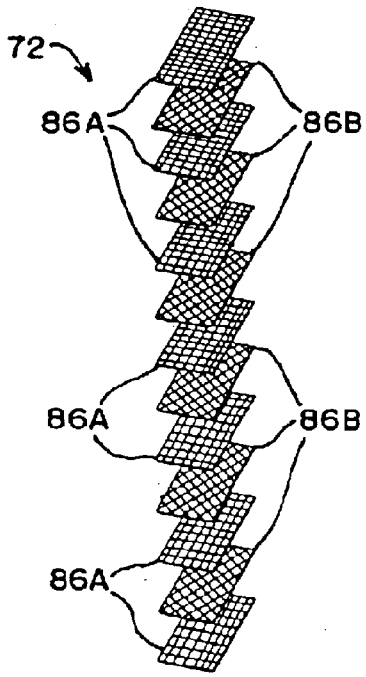
FIG. 7
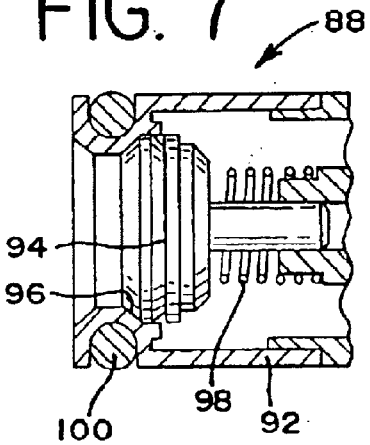

CASCADING TUB FILLER AND OVERFLOW ASSEMBLY

FIELD OF THE INVENTION

The present invention relates to an improved cascading tub filler and overflow assembly that is mounted at the overflow opening in the wall of a bathtub.

DESCRIPTION OF THE PRIOR ART

A bathtub normally has a selectively open or closed waste, or drain, opening in its bottom wall and a continuously open overflow opening in its side wall below the top of the tub. If the tub is overfilled, excess water flows through the overflow opening and into the drain system, rather than flooding over the top of the tub onto the floor.

In a conventional tub plumbing system, the tub is filled from a spout supplied from a faucet assembly. The spout is usually mounted on a wall or is otherwise supported above the tub, and extends out over the tub. The spout can be an obstruction and can result in a cluttered appearance. In some applications, this configuration is thought to detract from a desired appearance and dé cor. As a result there is a need for a tub filler that can be integrated with the plumbing overflow assembly at the tub overflow opening.

Ernst et al. U.S. Pat. No. 1,685,159 discloses a bathtub fitting adapted to serve as a supply, overflow and shower combination. In this fitting, the tub is filled by flow into the tub through the tub overflow opening. Water flows through an arcuate passage 34 and into the tub through an escape opening 31 defined between a face fitting 22 and the tub wall. Farmer U.S. Pat. No. 6,219,858 discloses variations on this type of arrangement wherein the water inlet entirely surrounds the water overflow outlet (FIGS. 1-3) or wherein a penannular body cooperates with the water inlet to surround the water overflow outlet (FIGS. 4 and 5).

Although integrating the tub filler with the tub overflow system at the tub overflow opening can provide a trim and unobstructed appearance, there are difficulties to be overcome in providing a satisfactory installation. There should be provision to prevent bath water from an overfilled tub from flowing through the inlet an into the water supply system. In addition, water should enter the tub at a high rate, and in a smooth, cascading flow.

SUMMARY OF THE INVENTION

A primary object of the present invention is to provide a tub filler and overflow assembly that is located at the tub overflow opening. Other objects are to provide a tub filler and overflow assembly that achieves a high fill rate without obstructing overflow from the tub; to provide a tub filler and overflow assembly that provides an attractive, smooth cascading flow into the tub; to provide a tub filler and overflow assembly that prevents tub water from entering the water supply; and to provide a tub filler and overflow assembly overcoming the disadvantages of known tub filler arrangements.

In brief, in accordance with the invention there is provided a tub filler and overflow assembly for mounting in an overflow opening in a tub wall. The assembly includes inner and outer bodies and a fastener connecting the bodies and adapted to draw them together to clamp toward opposed faces of the tub wall around the overflow opening. An overflow water outlet passage extends through the inner and outer bodies. A water inlet passage extends through the inner and outer bodies. The water inlet passage has an inlet defined by the outer body and an outlet defined by the inner body. A flow conditioning assembly is supported by the inner body at the outlet of the water inlet passage. The outlet and the flow conditioning assembly define a non-circular water discharge opening. The inlet flow conditioning assembly includes a non-circular screen assembly in series flow relationship with the water discharge opening. The screen assembly includes a plurality of screen laminas each having a plurality of interstices for flow of water through the screen assembly.

BRIEF DESCRIPTION OF THE DRAWING

The present invention together with the above and other objects and advantages may best be understood from the following detailed description of the preferred embodiment of the invention illustrated in the drawings, wherein:

FIG. 6 is a cross sectional view of the cascading tub filler and overflow assembly taken along the line 6—6 of FIG. 4;

FIG. 7 is a fragmentary cross sectional view of the check valve of the cascading tub filler and overflow assembly taken along the line 7—7 of FIG. 6; and FIG. 8 is an exploded isometric view of the screen assembly of the inlet flow conditioning assembly.

DETAILED DESCRIPTION OF THE PREFERRED EMBODIMENT

Figure 2:
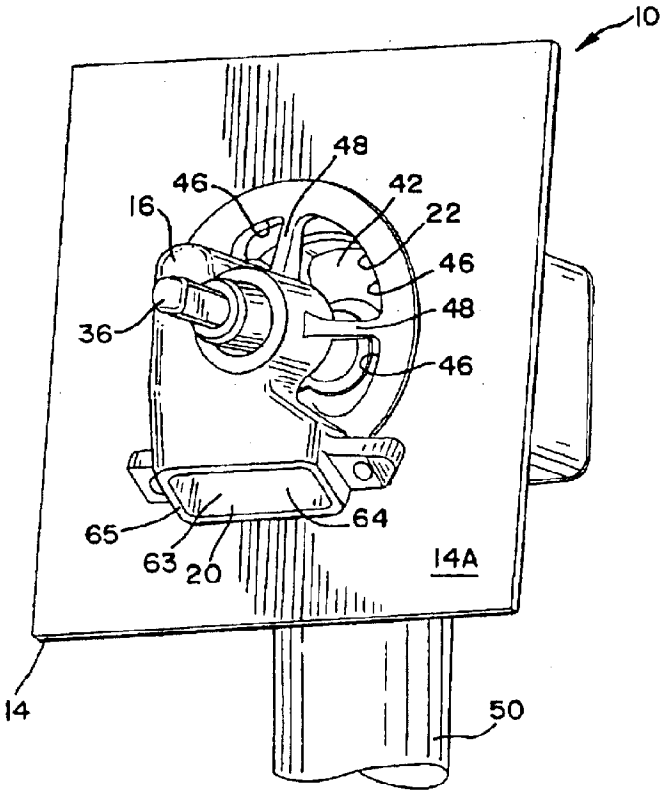
FIG. 2 is a view like FIG. 1 with the inlet flow conditioning assembly, the handle and the cover removed.
Figure 1:
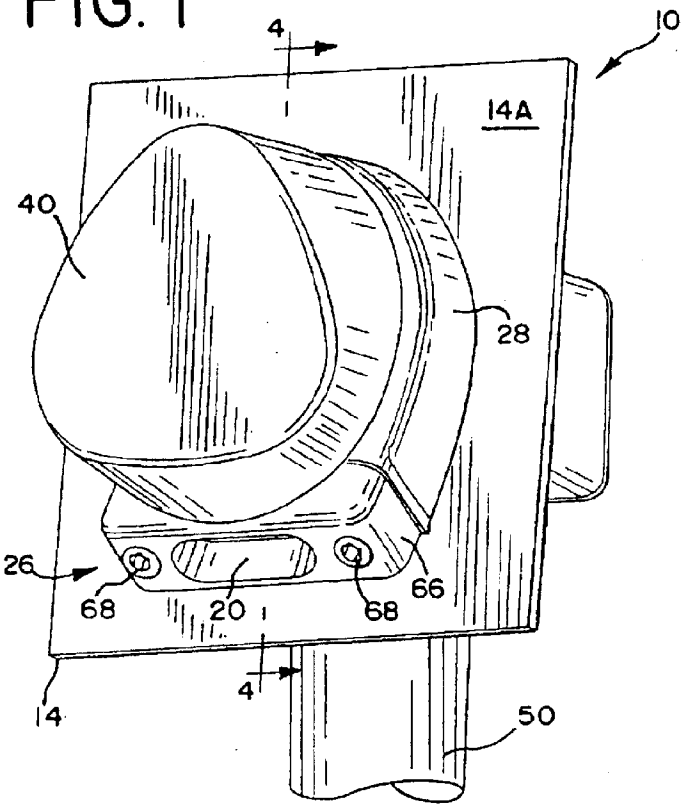
FIG. 1 is an isometric view of a tub mounted cascading tub filler and overflow assembly constructed in accordance with the present invention.
Figure 3:
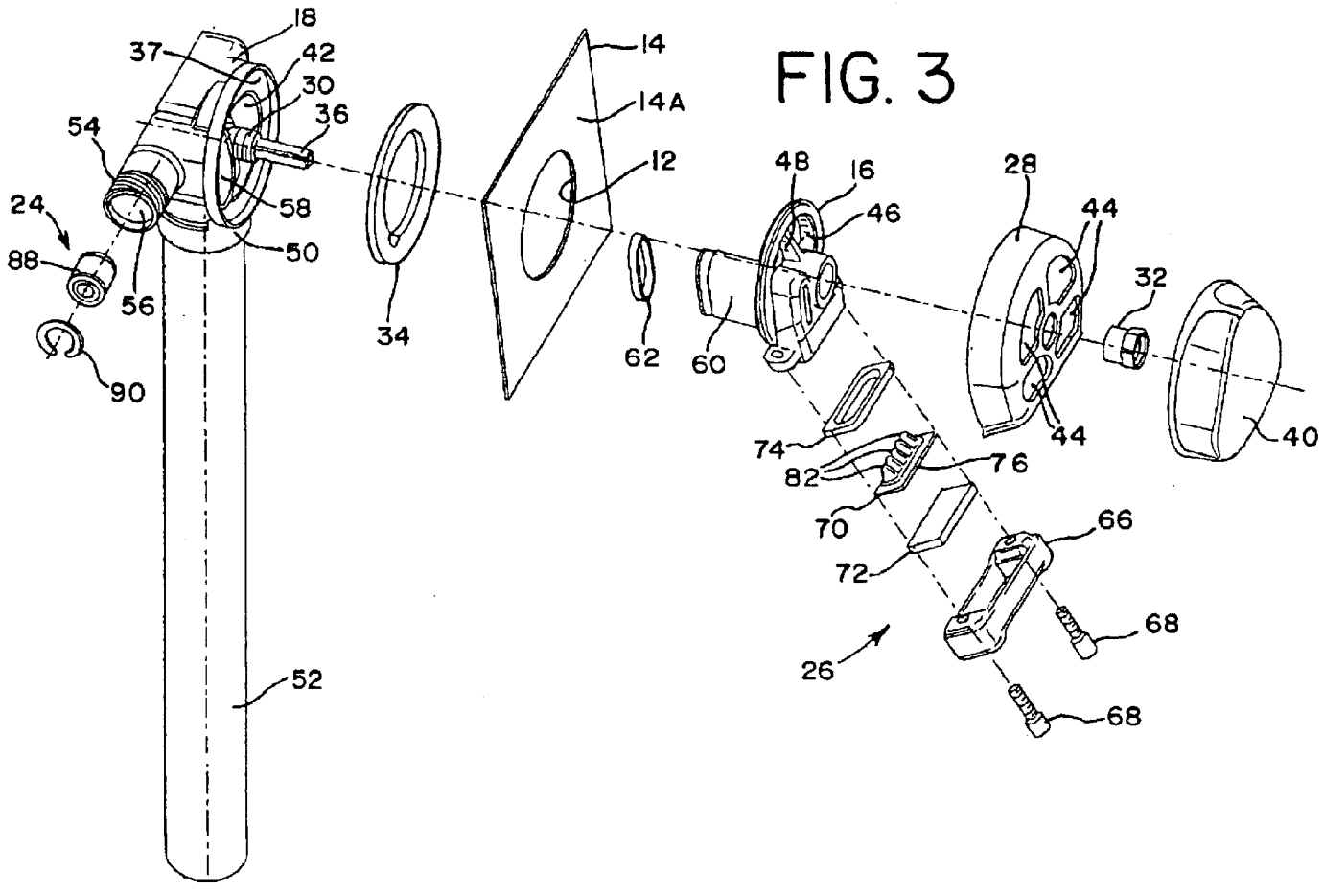
FIG. 3 is an exploded isometric view of the components of the cascading tub filler and overflow assembly.

Having reference now to the drawing, FIG. 1 illustrates a tub filler and overflow assembly generally designated as 10 and constructed in accordance with the principles of the present invention. The assembly 10 is mounted at the overflow opening 12 (FIGS. 3, 4 and 6) in the side wall 14 of a bath tub and provides an integrated assembly for filling the tub from a water supply and for overflow from an overfilled tub.

In general, the tub filler and overflow assembly 10 includes an inner body 16 and an outer body 18 respectively clamped toward the inner surface 14A and outer surface 14B of the tub wall 14. The bodies 16 and 18 cooperate to define a water inlet passage 20 and a overflow water outlet passage 22. Associated with the water inlet passage are a backflow preventer assembly 24 and an inlet flow conditioning assembly 26.

A decorative cover 28 hides the inner body 16 from view, and a hollow screw 30 and mating hollow nut 32 (FIGS. 4 and 6) hold the cover 28 and the bodies 16 and 18 together with the bodies 16 and 18 clamped against opposite faces 14A and 14B of the wall 14. A rib 35 centers the body 16 in the opening 12. A gasket 34 is compressed between a seal surface 37 of the body 18 and the tub wall outer surface 14B around the tub opening 12 in order to prevent leakage from the overflow water outlet passage 22.

In the illustrated embodiment of the invention, the tub filler and overflow assembly 10 is part of a cable controlled waste and overflow installation in which a cable operated from the assembly 10 moves a plunger to open or close a tub waste or drain opening. A shaft 36 extends through the hollow screw 30 and nut 32, and a lever 38 at the outer end of the shaft operates a waste control cable. A handle 40 at the inner end of the shaft is rotated by the user to move the lever and cable and thereby open or close the waste opening.

The overflow water outlet passage 22 includes a chamber 42 defined in the outer body 18 and between the inner and outer bodies 16 and 18. Overflow water enters this chamber through ports 44 in the cover 28 and ports 46 in the inner body 16 defined between ribs 48. Overflow water exits the chamber 42 through a fitting 50 connected to a drain pipe 52 that communicates with a plumbing drain and vent system, typically in the region of the tub waste or drain connection.

The water inlet passage 20 includes a threaded side entry fitting 54 for connection to a water supply system. Typically the fitting 54 is connected to a pipe leading from a valve assembly providing a mixture of hot and cold water to fill the tub. A passage 56 within the fitting 54 leads to a horizontally extending, tubular, oval shaped cavity 58 defined in the outer body 18. The cavity 58 slideably receives a horizontally extending flow conduit 60 with a telescoping fit that accommodates a range of tub wall thicknesses. A gasket 62 provides a sliding seal around the inlet passage 20 between the inner and outer bodies 16 and 18. Within the inner body 16, the conduit 60 communicates with a downwardly extending flow passage 64 through which water flows to fill the tub. The passage 64 has an exit opening 63 with a generally rectangular shape bounded by a rectangular lip 65.

The passages 56, 60 and 64 are relatively large in cross section, preferably about one-half square inch in cross sectional area, in order to fill the tub rapidly with a high rate of flow of as much as about twenty gallons per minute. Water flowing around the corner where the horizontal conduit 60 joins the downward passage 64 abruptly changes direction. As a result the flow is turbulent and the flow rate is not uniform across the width of the passage 64. If water were to flow directly from the passage 64, the flow would be chaotic and irregular with a tendency to splash or slosh in the tub.

The inlet flow conditioning assembly 26 provides a smooth, generally laminar, cascading flow into the tub and avoids splashing and sloshing. The assembly 26 includes a housing 66 held to the inner body 16 in alignment with the passage 64 by a pair of screws 68. The assembly 26 includes a flow straightener 70 and a screen assembly 72 in series flow relationship that act in concert to transform the turbulent flow entering the passage 64 into a smooth, controlled, uniform flow into the tub. The flow straightener 70 and the screen assembly 72 are captured within the housing 66, and a sealing gasket 74 is compressed between the flow straightener 70 and the lip 65 on the body 16 surrounding the passage 64.

Figure 4:
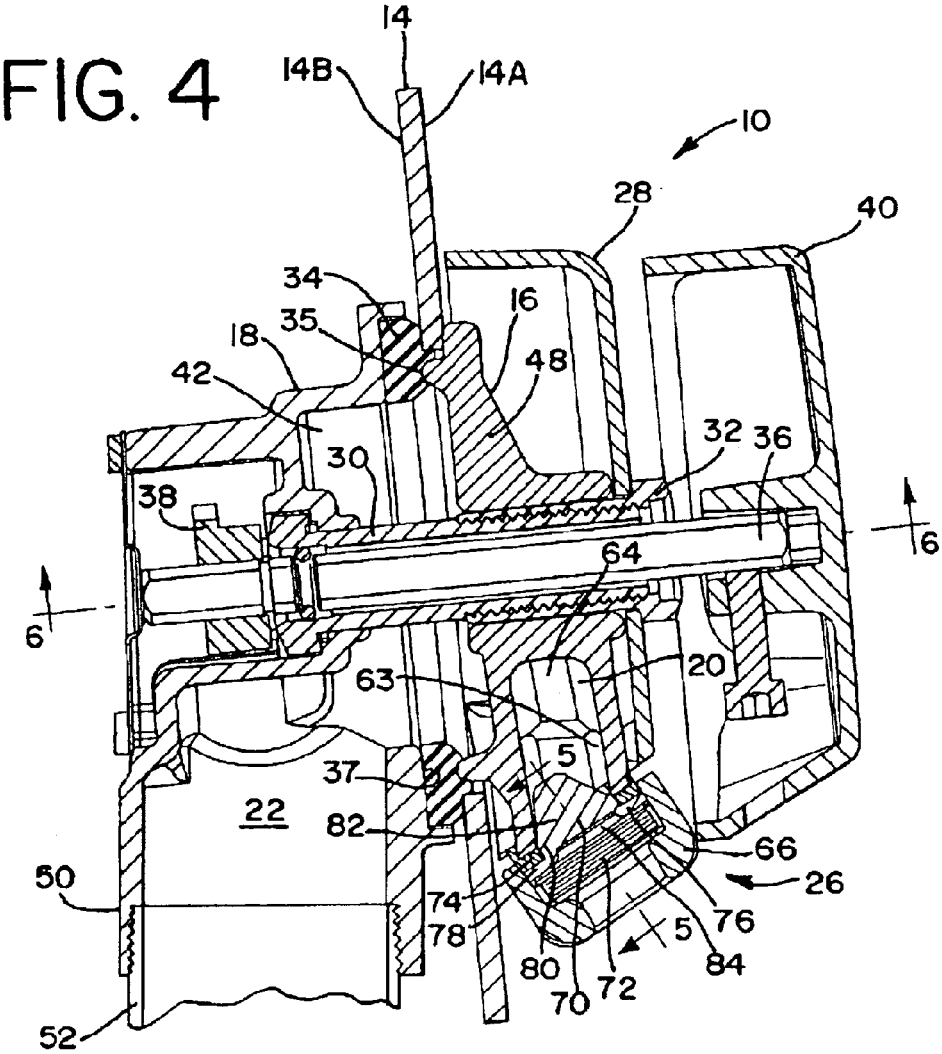
FIG. 4 is a cross sectional view of the assembly taken along the line 4—4 of FIG. 1.
Figure 5:
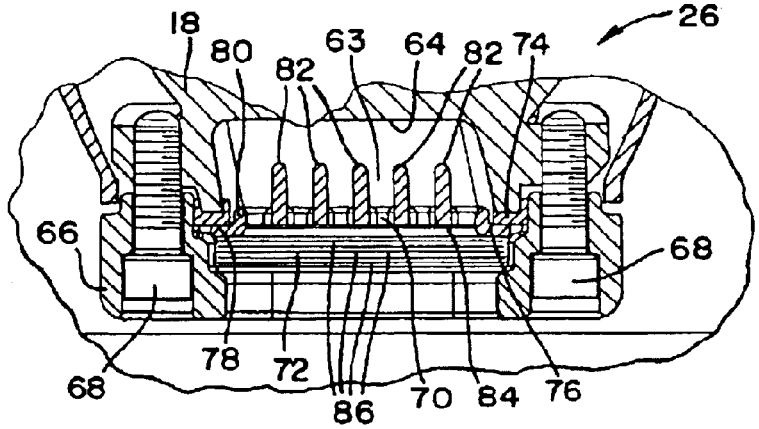
FIG. 5 is a cross sectional view of the inlet flow conditioning assembly taken along the line 5—5 of FIG. 4.

The flow straightener 70 includes a peripheral flange 76 including a seal retainer portion 78 that engages the gasket 74 and an upturned lip portion 80 that enters and registers with the passage 64 (FIGS. 4 and 5). The flange 76 has generally the same rectangular shape as the exit opening 63 of passage 64. This rectangular shape is elongated with its longitudinal axis generally parallel to the tub wall 14. As a result, water introduced into the tub is supplied in a wide cascade rather than in a circular stream that is typical of typical spouts. In addition the exit opening 63 and the housing 66 are inclined at an angle of about thirty degrees away from the tub wall surface 14A. This inclination cascades the fill water out and into the tub rather than flowing it down the wall 14 for an attractive, pleasing effect.

A series of spaced apart flow separation barriers in the form of blades or vanes 82 span the narrower dimension of the rectangular flange 76, and are aligned with and extend upstream into the passage 64. The blades 82 are parallel to one another and lie in planes parallel to the desired direction of water flow. Turbulent water leaving the passage 64 is subdivided into a relatively small number of separated flow segments that are straightened by the blades 82. In the illustrated arrangement there are five blades 82 providing six separate flow segments, but different numbers of blades and segments could be chosen. A number of separated flow segments in the range of three to ten would provide the benefits of the present invention.

The downstream ends of the blades 82 are spaced below the surface of the seal retainer flange portion 78 to define a header region 84. The flow segments separated in the flow straightener are briefly reunited in the unobstructed common header region 84 located between the flow straightener 70 and the screen assembly 72. The total flow recombines into a single flow in this region. At this point along the flow path some of the turbulence resulting from flow around the corner from conduit 60 into passage 64 is attenuated by the straightening effect of the blades 82. In addition the flow rate and direction at this point is more uniform across the entire area of the flow path.

The screen assembly 72 is a laminar body including a number of screens 86 forming successive laminas in series flow relationship along the path of flow from the header region 84. The screen laminas 86 extend across the path of flow through the inlet flow conditioning assembly. Preferably the laminas are attached together by spot welding, sintering or the like. However, the laminar screens 86 could be loose and captured in the housing 66. The screens of the laminas are oriented differently in order to increase the effective flow length through the assembly 72. The effect is to regulate flow by successively dividing the total flow into a relatively large number of briefly separated and partially reunited flow segments so that each constituent of the flow changes direction numerous times within the screen assembly 72.

Each lamina is preferably a screen mesh having numerous interstices. In the illustrated embodiment of the invention, each screen 86 is a 1.625 inch by 0.725 inch panel of thirty by thirty mesh count bolting grade mesh of 0.0065 inch diameter wire. The mesh count and wire diameter of all of the screen 86 are the same. In this arrangement, each screen includes more than about one thousand interstices, and each screen divides the total flow into more than about one thousand constituents. Other screens or similar laminas could be used, provided that the flow is divided into at least hundreds of constituents.

The wires of each lamina 86 are angularly offset from the wires of the adjacent laminas 86 so that each successive screen causes the numerous flow constituents from the prior screen to partially reunite and at the same time to separate into new constituents while causing successive flow redirections. In the illustrated embodiment the assembly 72 has fifteen screen laminas 86 and the wire directions of alternate screen laminas 86A are oriented the same while the interspersed other alternate screens 86B have wire directions angularly offset by forty-five degrees from the wire directions of the screen laminas 85A. Other angular relationships could be used. The number of screens can be selected in order to obtain the desired result. Fewer screens result in less flow resistance and more exit flow turbulence, while more screens result in more flow resistance and in a more regulated, laminar flow from the inlet flow conditioning assembly 26. The advantages of the invention can be realized with screen laminas numbering about five or more.

Overfilling of the tub could result in the water level rising above the inlet flow conditioning assembly and passage 64. In order to prevent the flow of bath water into the water supply system, a backflow preventing check valve cartridge 88 is secured in the flow passage 56 within the fitting 54 by a retaining ring 90. As seen in FIG. 7, the check valve 88 includes a housing 92 containing a valve member 94 normally urged against a seat 96 by a spring 98. A seal 100 prevents bypass flow around the housing 92. The valve member compresses the spring 98 to move away from the seat 96 and permit flow into the tub, but closes against the seat 96 to prevent reverse flow in the opposite direction.

While the present invention has been described with reference to the details of the embodiment of the invention shown in the drawing, these details are not intended to limit the scope of the invention as claimed in the appended claims.

What is claimed is:

1. A tub filler and overflow assembly for mounting in an overflow opening in a tub wall, said assembly comprising:

inner and outer bodies;

a fastener connecting said bodies and adapted to draw them together to clamp toward opposed faces of the tub wall around the overflow opening;

an overflow water outlet passage extending through said inner and outer bodies;

a water inlet passage extending through said inner and outer bodies, said water inlet passage having an inlet defined by said outer body and an outlet defined by said inner body; and an inlet flow conditioning assembly supported by said inner body at said outlet of said water inlet passage;

said outlet and said flow conditioning assembly defining an elongated water discharge opening having a longitudinal axis generally parallel to the tub wall;

said inlet flow conditioning assembly including an elongated screen assembly in series flow relationship with said water discharge opening;

said screen assembly including a plurality of screen laminas each having a plurality of interstices for flow of water through the screen assembly.

2. A tub filler and overflow assembly as claimed in claim 1, said water discharge opening and said screen assembly being generally rectangular.

3. A tub filler and overflow assembly as claimed in claim 1, said water discharge opening being angularly inclined away from the tub wall.

4. A tub filler and overflow assembly as claimed in claim 1, said flow conditioning assembly including a flow straightener upstream of said screen assembly.

5. A tub filler and overflow assembly as claimed in claim 1, further comprising a check valve in said overflow water outlet passage-permitting flow only in the direction from said outer body to said inner body.

6. A tub filler and overflow assembly as claimed in claim 5, said check valve being mounted on said outer body.

7. A tub filler and overflow assembly for mounting in an overflow opening in a tub wall, said assembly comprising:

inner and outer bodies;

a fastener connecting said bodies and adapted to draw them together to clamp toward opposed faces of the tub wall around the overflow opening;

an overflow water outlet passage extending through said inner and outer bodies;

a water inlet passage extending through said inner and outer bodies, said water inlet passage having an inlet defined by said outer body and an outlet defined by said inner body; and an inlet flow conditioning assembly supported by said inner body at said outlet of said water inlet passage;

said outlet and said flow conditioning assembly defining a water discharge opening;

said inlet flow conditioning assembly including a screen assembly in series flow relationship with said water discharge opening, and including a flow straightener upstream of said screen assembly;

said screen assembly including a plurality of screen laminas each having a plurality of interstices for flow of water through the screen assembly;

said flow straightener including a plurality of barriers dividing flow through the flow straightener into a number of separated flow segments;

said water discharge opening, said screen assembly and said flow straightener having similar, elongated, generally rectangular shapes with opposed shorter walls and opposed longer walls, said barriers comprising vanes extending between said opposed longer walls, said vanes being parallel to one another and parallel to the direction of flow through said inlet flow conditioning assembly.

8. A tub filler and overflow assembly as claimed in claim 7, further comprising an unobstructed header region between said flow straightener and said screen assembly.

9. A tub filler and overflow assembly as claimed in claim 7, said water inlet passage having a corner immediately upstream of said flow conditioning assembly.

10. A tub filler and overflow assembly as claimed in claim 7, said plurality of vanes numbering between three and ten.

11. A tub filler and overflow assembly as claimed in claim 7, each said screen lamina comprising a wire mesh, the wire direction of each said screen lamina being angularly offset from the wire direction of an immediately adjacent one of said screen laminas.

12. A tub filler and overflow assembly as claimed in claim 11, said screen laminas being attached together by a process such as spot welding or sintering.

13. A tub filler and overflow assembly as claimed in claim 12, alternate ones of said screen laminas having wire directions angularly offset by about forty-five degrees from the wire directions of the remaining ones of said screen laminas.

14. A tub filler and overflow assembly as claimed in claim 12, said plurality of screen laminas numbering five or more.

15. A tub filler and overflow assembly as claimed in claim 14, said plurality of interstices of each said screen lamina numbering at least in the hundreds.

* * * * *